US007975613B2

(12) United States Patent
Labuschagne et al.

(10) Patent No.: US 7,975,613 B2
(45) Date of Patent: Jul. 12, 2011

(54) BLASTING SYSTEM AND METHOD

(75) Inventors: Albertus Abraham Labuschagne, Brakpan (ZA); Andre Louis Koekemoer, Boksburg (ZA); Craig Charles Schlenter, Johannesburg (ZA)

(73) Assignee: Detnet South Africa (Pty) Limited (ZA)

( * ) Notice: Subject to any disclaimer, the term of this patent is extended or adjusted under 35 U.S.C. 154(b) by 0 days.

(21) Appl. No.: 12/962,137

(22) Filed: Dec. 7, 2010

(65) Prior Publication Data

US 2011/0100244 A1 May 5, 2011

Related U.S. Application Data

(63) Continuation of application No. 11/553,301, filed on Oct. 26, 2006, now abandoned.

(51) Int. Cl.
*F23Q 7/02* (2006.01)

(52) U.S. Cl. ..... 102/217; 102/312; 102/215

(58) Field of Classification Search ..... 102/200, 102/206, 215, 217, 312
See application file for complete search history.

(56) References Cited

U.S. PATENT DOCUMENTS

| | | | |
|---|---|---|---|
| 4,674,047 | A | 6/1987 | Tyler |
| 5,014,622 | A | 5/1991 | Jullian |
| 5,090,321 | A | 2/1992 | Abouav |
| 5,295,438 | A | 3/1994 | Hill |
| 5,520,114 | A | 5/1996 | Guimard |
| 5,894,103 | A | 4/1999 | Shann |
| 6,173,651 | B1 | 1/2001 | Pathe |
| 6,604,584 | B2 | 8/2003 | Lerche |
| 6,644,202 | B1 | 11/2003 | Duniam |
| 6,941,870 | B2 | 9/2005 | McClure |
| 7,156,023 | B2 | 1/2007 | Aebi |
| 7,650,841 | B2 | 1/2010 | McClure |
| 2003/0136289 | A1 | 7/2003 | Hallin et al. |
| 2004/0225431 | A1 | 11/2004 | Aebi |
| 2005/0103219 | A1 | 5/2005 | McClure |
| 2007/0272110 | A1 | 11/2007 | Brent |
| 2008/0134923 | A1 | 6/2008 | Lownds |

FOREIGN PATENT DOCUMENTS

| | | | |
|---|---|---|---|
| WO | 00/09967 | A1 | 2/2000 |
| WO | 01/67031 | A1 | 9/2001 |

OTHER PUBLICATIONS

International Preliminary Examination Report on Patentability for PCT/ZA2006/000123, international filing date of Oct. 30, 2006, mailed Feb. 4, 2009, 11 pages.
International Search Report for PCT/ZA2006/000123, international filing date of Oct. 30, 2006, mailed Jul. 26, 2007, 3 pages.
Written Opinion for PCT/ZA2006/000123, international filing date of Oct. 30, 2006, mailed Jul. 26, 2007, 7 pages.
EPO Official Communication for EP Application No. 06 846 887.5-1260, dated Dec. 8, 2009, 7 pages.

*Primary Examiner* — Michael Carone
*Assistant Examiner* — Daniel Troy
(74) *Attorney, Agent, or Firm* — Cantor Colburn LLP

(57) ABSTRACT

The invention provides a blasting system which includes a plurality of electronic detonators which are configured in a blast array which has at least one row and a plurality of detonators in the row, each detonator including a memory in which is stored at least a respective identity code which is dependent, at least, on the row on which the detonator is, and on the detonator's position in the row, a harness which interconnects the detonators, and at least one control unit, connected to the harness, which generates a signal to fire the detonators.

26 Claims, 4 Drawing Sheets

BLASTING SYSTEM AND METHOD

CROSS-REFERENCE TO RELATED APPLICATION

This application is a continuation of U.S. application Ser. No. 11/553,301 of Albertus Abraham Labuschagne et al. for "Blasting System and Method" filed on Oct. 26, 2006 now abandoned and subsequently abandoned.

BACKGROUND OF THE INVENTION

This invention relates to a blasting method which makes use of electronic detonator.

In one respect electronic blasting systems can be divided into systems which are implemented using two wires which interconnect the detonators, and systems which make use of more than two wires.

In a system of the former kind blast times for the various detonators are usually assigned while a blaster is working at a blasting bench.

In a multi-wire system (of the latter kind) the additional wires allow the connection order of the detonators to be established and the wiring order can be used to determine blast timing factors. This type of system can be easier to use as the blaster can readily configure the blast pattern in terms of inter-detonator and inter-row timing increments.

Some blasting systems make use of a location system such as a global positioning system (GPS) to collate the identity of a particular detonator with a geographical location in the blasting system. A blast time is then assigned to the detonator using the geographical coordinates of the detonator in the blast system. A GPS based system, in order to be sufficiently accurate, does however require the use of a GPS reference station. A further factor is that GPS location data may not be sufficiently accurate or readily available, due for example to a rock wall or rock body which blocks reception of a GPS signal.

Although, as noted, a multi-wire blast system is generally easy to use a two-wire blast system has an economic benefit in that the cost of the wire and of the components used to make connections within the system is lower than the cost of a multi-wire system.

The invention is concerned with a blasting system which is readily implemented in a two-wire mode and which, if required, allows the visualisation of a blast pattern.

SUMMARY OF INVENTION

The invention provides a method of operating a blasting system which includes an array of electronic detonators, the method including the step of assigning an identity code to each detonator which is determined at least partly by the detonator's location in the array.

The array may be formed by a plurality of boreholes arranged in at least one row. Each row is assigned a respective row identifier and each borehole in each row is assigned a respective borehole identifier. Each borehole may contain at least one detonator and the identity code for the detonator is dependent at least on the respective row identifier and on the respective borehole identifier.

The meaning of the term "row" in one respect may be notional. The term is intended to include at least a succession of boreholes which may be positioned along a straight, curved or irregular path. For example, in an underground situation at a workface e.g. a tunnel end, the boreholes may be grouped in circular or other arrays.

A row identifier, or a borehole identifier, may then be determined by an actual row or borehole count, or by means of a sequential notation system e.g. an ordering arrangement based on a sequence in which the detonators, individually or in groups (rows), are to be fired.

If a borehole contains at least first and second detonators either at the same position or at different positions in the hole, i.e. if use is made of multiprime or decking techniques, then the identity code for the first detonator may be distinguishable from the identity code for the second detonator.

The identity code for a detonator may be dependent on the position of the detonator, for example on the length of wire which extends from a mouth or collar of the borehole to the detonator.

The identity code may additionally depend on the position of the borehole, in a first direction or in a second direction, from a reference point, in the respective row. The choice of the reference point may vary but, conveniently, a detonator in the row which fires first i.e. has the shortest time delay period, is used to fix the reference point.

The identity code of a detonator may be stored in a memory in the detonator and in the memory of a portable device. The portable device may be used for generating the identity code.

The portable device may be used for transferring the identity codes of the detonators to a suitable destination e.g. a control unit, a storage device, a memory stick, a computer, etc. This transfer may be done using a physical connection e.g. wire or fibre optic, or wirelessly e.g. by using a radio frequency, infrared or other technique. The control unit may be used for associating respective firing time information with each identity code. The firing time information for a detonator may be dependent on the detonator's location in the array e.g. on the detonator's identity code.

The control unit may transfer the firing time information to each respective detonator and may be used for firing the detonators. One or more intermediate control units (slave units) can be used between the control unit and the detonators to achieve a larger blast pattern than what is possible using the control unit alone, or to exercise localised or specific control techniques over some of the detonators in the array.

The method may be implemented in conjunction with safety and security protocols of any appropriate kind to ensure that adequate safeguards are in place to control the authorisation of the blast.

The identity code of each detonator may be used to generate a visual or textual representation of the detonator array.

In a variation of the invention the method includes the steps of arranging a plurality of electronic detonators which are spatially distributed from one another in an array, storing in each detonator a respective identity code which is dependent on the detonator's location in the array, transferring the identity codes for the detonators to a control location, storing in each detonator respective firing time information which is transferred from the control location, and transmitting a firing signal to the detonators.

The firing time information may be generated or allocated using any suitable technique or algorithm based for example on a regular inter-row and inter-hole time difference. Irregular holes or unusual situations can be accommodated by allowing an operator to allocate specifically determined firing time information to the corresponding detonators.

The invention also provides a blasting system which, in one form, includes a plurality of electronic detonators which are configured in a blast array which has at least one row and a plurality of detonators in the row, each detonator including a memory in which is stored at least a respective identity code which is dependent, at least, on the row in which the detonator is, and on the detonator's position in the row, a harness which interconnects the detonators, and at least one control unit, connected to the harness, which generates a signal to fire the detonators.

Firing time information may be stored in the memory. This may be in addition to the identity code, or the firing time information may, at the appropriate time, overwrite at least part of the identity code.

The detonators may be positioned in a plurality of boreholes with at least one detonator in each borehole.

If use is made of multiple control units then these can be configured in a master-slave relationship with each slave firing a respective group of detonators.

In a different form of the invention the blasting system includes a plurality of electronic detonators which are spatially distributed from one another in an array, each detonator including a memory in which is stored, at least, a respective identity code which is dependent, at least, on the detonator's location in the array, a harness which interconnects the detonators in parallel to one another, a portable device in which are stored the identity codes for the detonators, and a control apparatus in which are stored the identity codes and firing time information for each detonator and which transmits a firing signal on the harness to the detonators.

The control apparatus may comprise a single control unit or a number of control units configured to act in parallel in a synchronised way, or in a master-slave relationship.

The harness may comprise two elongate conductors and a plurality of connectors, at least one connector for each detonator, connected at intervals to the conductors.

The portable device may include a housing, a data input mechanism for inputting data relating to a detonator's location in the detonator array, a processor which, in response to the input data, is operable under the control of an algorithm to generate an identity code for the detonator which is dependent at least on the detonator's location in the array, a first memory in which the identity code is stored, and a two-connection interface for transferring the identity code to the respective detonator.

The portable device may include communication means for receiving data or signals from, or transferring data or signals to, an external device such as control apparatus or a control unit of the kind referred to, a computer, a storage device or the like.

The data and signal transfer may be done via physical links (wire or cable) or wirelessly (at infrared or radio frequencies).

The control unit may include communication means for receiving data or signals from, and for transferring data or signals to, by wireless links (radio frequencies, infrared etc.) or via physical links (wire, fibre optic cable etc.), the portable device referred to or one or more of the detonators.

The control unit may include a housing, a control memory in which are stored firing time information for each of a plurality of detonators in the array and a respective identity code for each of the detonators, each identity code being dependent at least on the location of the respective detonator in the array, and a two-connection interface for transferring the firing time information to the respective detonators.

BRIEF DESCRIPTION OF THE DRAWINGS

The invention is further described by way of example with reference to the accompanying drawings in which.

DESCRIPTION OF PREFERRED EMBODIMENT

Figure 1:
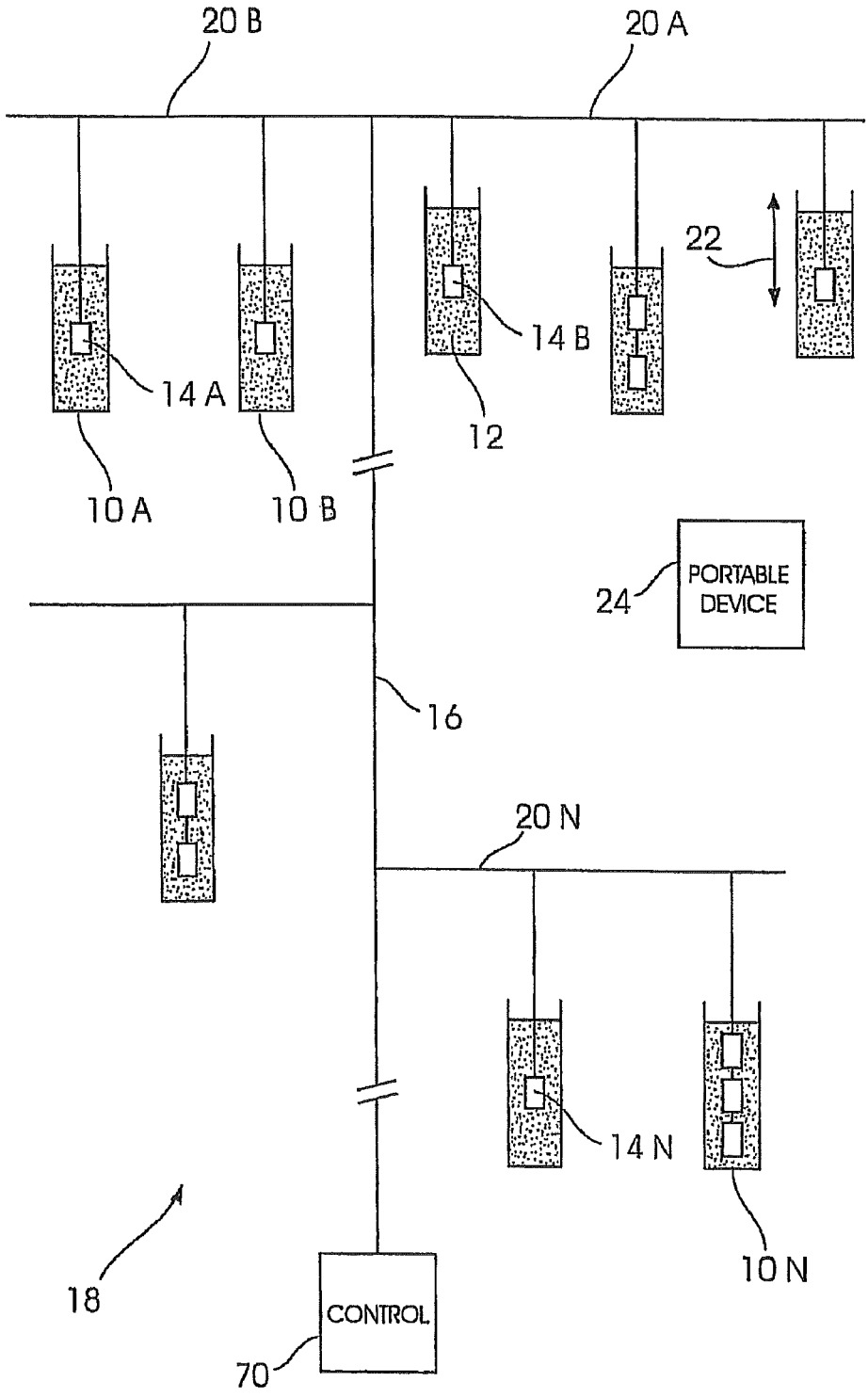
FIG. 1 illustrates an array of electronic detonators in a blasting system.

FIG. 1 of the accompanying drawings illustrates a number of boreholes 10A, 10B . . . 10N respectively formed at predetermined positions in the ground using conventional techniques. The depth of a borehole and its size may vary according to requirements known in the art.

Each borehole contains explosive material 12 and at least one respective detonator 14A, 14B . . . 14N.

A two-wire harness 16 is used to connect the detonators to one another in an array 18 which is defined by rows of detonators 20A, 20B, . . . 20N and, within each row 20, the boreholes 10A, 10B . . . which are in the row. The array can be further particularised by the number of detonators in a borehole. As is shown in FIG. 1 most of the boreholes contain one detonator but a limited number contain two detonators and one borehole contains three detonators. A number can be assigned to each detonator when they are decked or stacked in this way and this feature also characterises the blast array. Apart from the deck number the depth of a detonator inside a borehole can be used to characterise the blast array yet further. This can be assessed in any appropriate way, for example by the length 22 of a portion of the wire or harness which extends from the mouth or collar of the borehole in question to the detonator.

Another factor which can characterise the blast array is an indication of whether a particular detonator is to the left or the right of a chosen point in a row of detonators. This point can be chosen according to various criteria but conveniently can be determined by the position of a detonator in the row which will be fired first i.e. has the shortest time delay period.

The aforegoing parameters together with other information such as the spacing between rows of detonators and the spacing between adjacent detonators in a row, can be used, preferably with a suitable computer program, to generate a textual or graphical representation of a blast pattern.

The concept of "row" as used herein could be physical e.g. a group of boreholes could be configured or associated with each other in a definite pattern (such as a straight or curved line, a circle or the like) which is discernable as a "row", or notional in the sense that a sequence or string of detonators at chosen yet irregularly situated positions, are referred to as a "row".

Figure 2:
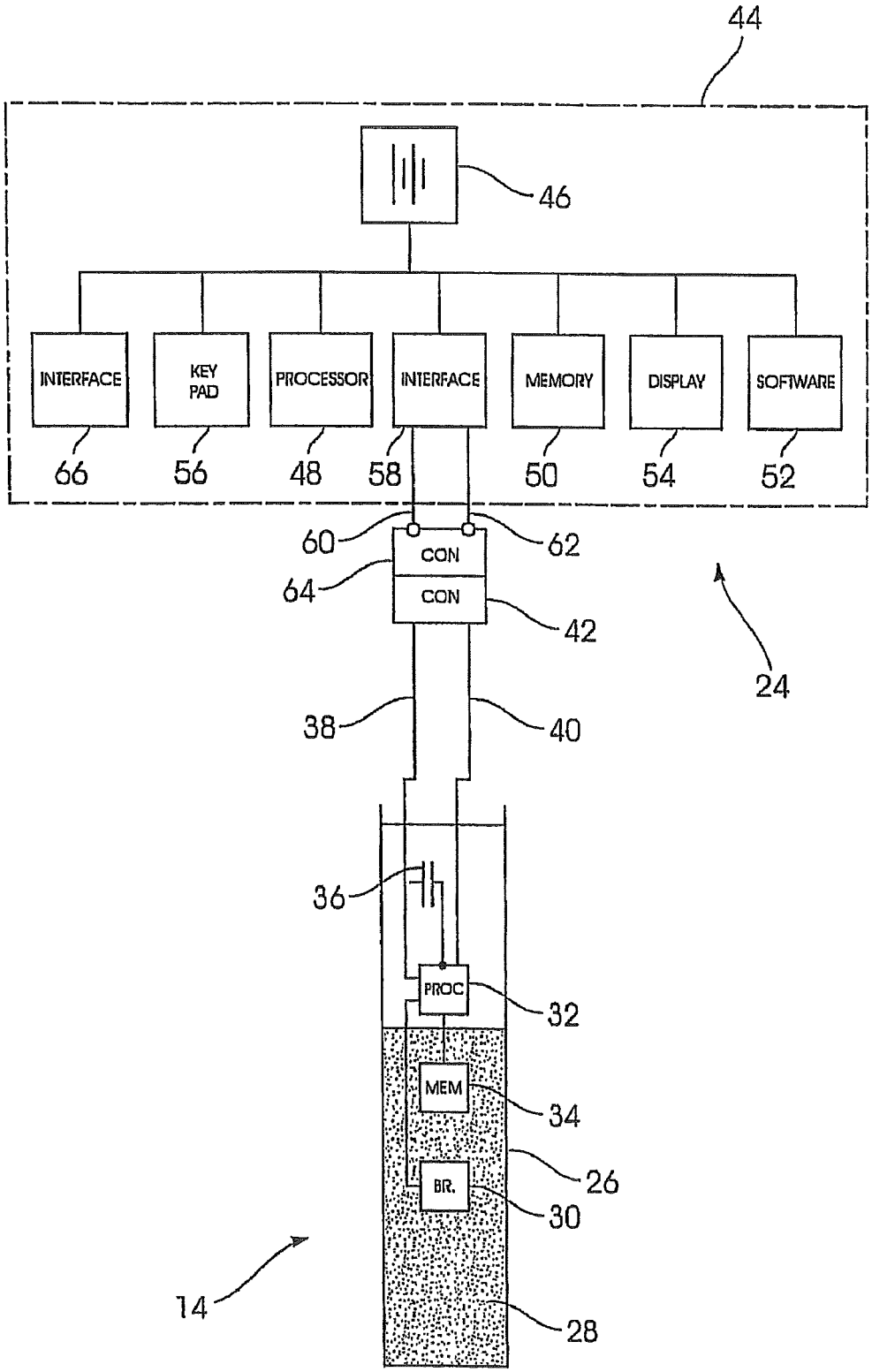
FIG. 2 shows, in block diagram form, a portable device used in the blasting system of the invention, connected to a detonator.

FIG. 2 illustrates in block diagram form a portable device 24 connected to a detonator 14. The detonator is generally of conventional construction and includes a tube 26 which contains primary explosive 28. A bridge 30 is exposed to the primary explosive. The bridge is connected to a processor 32 or a dedicated or custom-designed device (ASIC), which has resident memory 34. Power for the operation of the circuit inside the detonator is provided from a capacitor 36. Two leads 38 and 40 extend from the detonator and terminate in a connector block 42.

The portable device 24 includes a housing 44 and, within the housing, a battery 46, a processor 48, a memory 50 and software 52 resident in further memory. A display 54 and a keypad 56 are mounted externally to the housing. An output interface module 58 is connected to two leads 60 and 62 which terminate in a connector block 64. The connector block is releasably engageable with the block 42, as required. The device 24 includes another communication interface 66 which enables communication to take place with an external apparatus such as a control unit (see FIG. 3), a computer, a memory stick or the like via wires or wirelessly as required.

Figure 3:
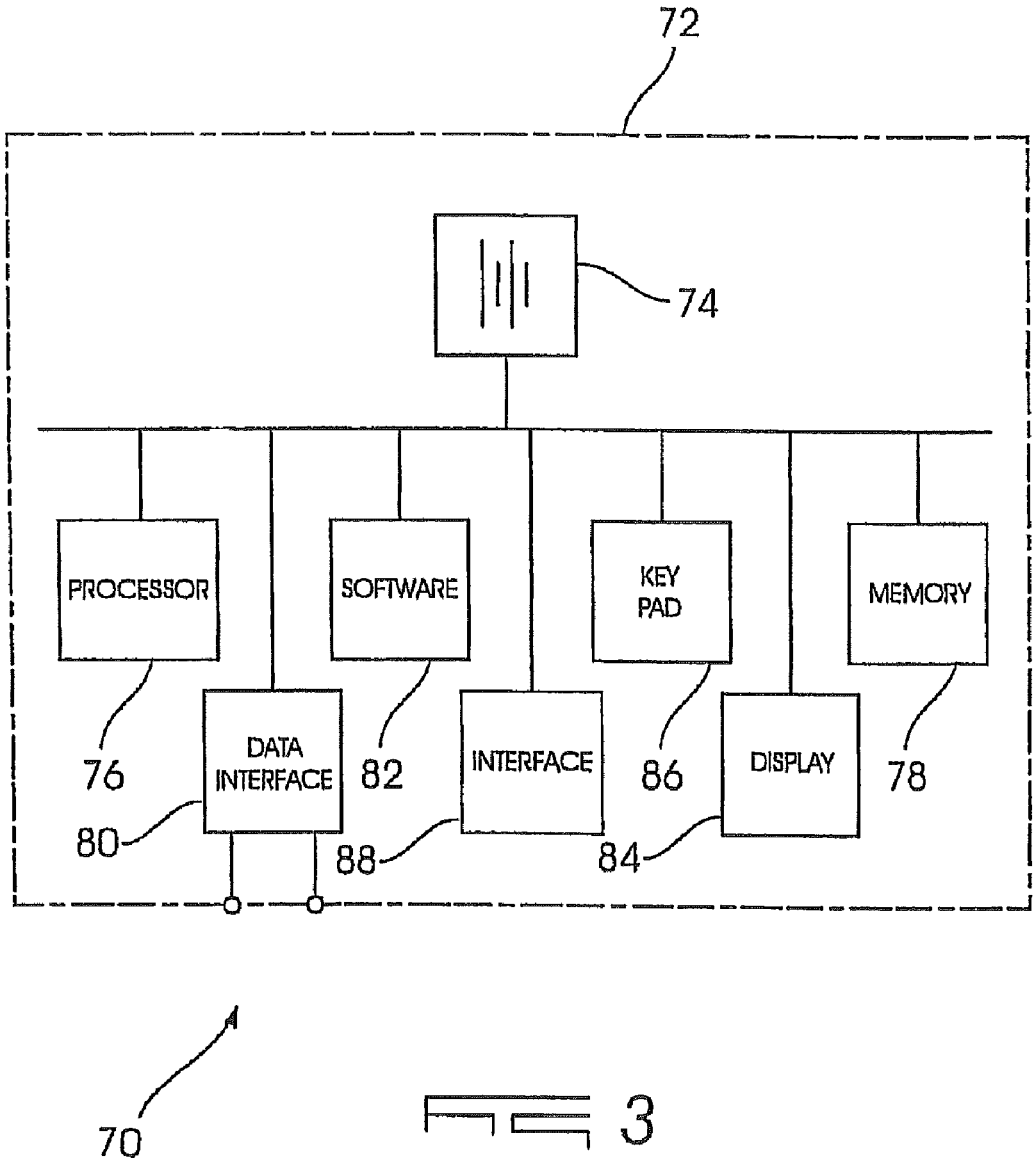
FIG. 3 is a block diagram illustration of a control unit.

FIG. 3 illustrates in block diagram form a control unit 70 which is used in the blasting system of the invention. The control unit can be configured as an integrally constructed item or from a number of discrete modules. The control unit includes a housing 72 and, inside the housing, a power supply 74, a processor 76, a memory 78, a data interface 80 and a software algorithm 82 stored in additional memory. A display 84 and a keypad 86 are externally fixed to the housing. The control unit can have another communication interface 88 to allow communication with an external device such as the portable device 24, a computer, a memory stick or the like, by wires or wireless, as required.

The control unit can be a single device or it can be one of a plurality of similar devices which make up apparatus which controls the blast. In the latter case the control units can be configured in a master-slave relationship, with the slave control units reacting to a single master control unit, or in parallel, with suitable synchronising controls to ensure that the control units, each of which can be used to fire a distinct respective group of detonators, are operated in step with one another.

The method of the invention is based on the principle of identifying a detonator by means of identifiers or data associated with the location in which the detonator is installed in the array 18. Under factory conditions each detonator 14 is manufactured according to known criteria. The memory 44 is not necessarily pre-programmed, as is often the case, with a unique identifier. The detonator includes a single capacitor 36 which is used for powering the detonator when required as is explained hereinafter. The battery 46 in the portable device 24 has a voltage which is inadequate to charge the capacitor 36 to a voltage which is sufficiently high to fire the bridge 30. Also, the voltage from the battery is not able, in any other way, to fire the bridge due to the presence of safety protocols and components which protect the bridge using techniques known in the art.

Once the boreholes 10 have been drilled in the ground the explosive material 12 and the detonators 14 are placed in the boreholes according to requirement. An operator, also referred to as a blaster, makes use of the portable device 24 and goes from borehole to borehole. At each borehole the connector 64 is connected to the connector 42 of the relevant detonator. The keypad 56 is manipulated by the blaster to input data pertaining to the position of the detonator in the blast array e.g. row one left, hole 3, deck 1, depth (22)× meters. These identifiers are processed by the processor 48, using an algorithm in the software 52 to generate a unique code which is used to distinguish the detonator in question. The identifiers may for example be used in the generation of a word (the identity code) as follows: the first byte of the word may represent the row number, the following byte may represent the hole number and a subsequent byte may represent the deck number.

Provision can however be made for the generation of specific identifiers which are used to identify specific conditions. For example it can be useful, to a blaster, to have knowledge or to be notified of a detonator at an end (physical or notional) of a row. Similarly a blaster might require notification or marking of a detonator at a branch or of some other irregularity, or chosen location, in the array.

This can be done by adding to or modifying the identity code for the particular detonator e.g. by adding one or more specific bits to the identity code. The "modified" identity code is, as before stored in the portable device and in the memory of the detonator.

Depending on options chosen in the software one of the identifiers (row or hole) can automatically increment as the blaster moves to a following hole. For example the hole number may increment automatically thus allowing the blaster to move to the next hole and detonator, and generate the identity code. The keypad 56 can be used as required to change the direction of the parameter the blaster is entering e.g. next row, next deck, etc. Visual and audible confirmation can provide feedback to the blaster if desired or even announce the current detonator number, hole number and so on.

Each of the detonators in the blast array is thus assigned a unique identity code which is stored in the memory 34 of the detonator. Also, during this process the identity codes for the detonators are accumulated in the memory 50 of the portable device. The codes can automatically be accumulated, or accumulation can take place only when the respective code has been loaded into a respective detonator which then transmits the code to the portable device, for storage in the portable device.

Once all the detonators have been identified the blaster connects the harness 16 to the detonators. The harness is a two-wire device and the detonators are thus linked to one another in parallel.

The portable device 24 is then placed in communication with the control unit 70. This can be done by directly coupling the device to the unit via the interfaces 58 and 80 or use can be made of another technique such as a short range radio frequency or infrared link. The control unit 70 then reads the identity codes from the memory 50. The connections of the harness to the detonators can be validated. The connected detonators can be counted to ensure that all detonators in the system are connected to the harness. Also, at an appropriate time each detonator can be calibrated, particularly to take account of thermal or other factors which can affect the accuracy of operation of timer circuits in the detonator.

The control unit 70 can also engage in an auto-search routine by issuing queries on the harness, possibly via a slave unit, to search for detonators. There is not necessarily a requirement, in this respect, for the control unit to interact with the portable device to identify which detonators are present in the installation. Appropriate heuristics can for example be applied to ensure that if a hole exists, a preceeding hole must logically exist, or for example to ensure that the last detonator in each row is identified appropriately, as the last detonator, so that useful messages can be presented to a blaster if there are errors.

The blaster may choose to use the portable device or the control unit to search for faults. One possible problem that may occur for example is if a blaster incorrectly assigns the same identity code to each of two detonators. One way of addressing this is for the portable device to warn if the blaster attempts to assign an identity code that has already been used. Another technique when testing the harness installation is to send an interrogating signal to the detonators and to examine the amplitude of a current modulated reply from the detonators. If a given detonator reply amplitude is larger than expected it could imply that two or more distinct detonators have the same identity code and are replying at the same time to a request from the portable device or control unit. The blaster is thereby alerted to this problem and can use techniques known in the art, such as a binary search, to find the detonators with the duplicate identity.

Once the relevant identity codes have been loaded into the control unit the blaster is presented with a representation of the number of detonators, holes, rows and the location of each detonator. This information is used to provide a textual or graphical depiction of the blast system or, if required, the information presents an image which can easily be inspected or assessed by a blaster to establish the correctness of the blast system. This, in turn, helps to identify an incorrect connection sequence, a "missing" detonator, or a similar fault.

At this stage in the process the detonators have not been programmed with firing time information. This can be done in a number of ways. In one approach an algorithm in the software 82 is used to generate firing times for the respective detonators using fixed inter-row, inter-detonator (for deck blasts) and inter-hole timings as is known in the art. Alternatively the detonators are programmed by the blaster using other criteria. In another approach the timing information is externally generated, for example in a separate computer which is coupled to the control unit and, thereafter, the timing information is loaded into the memory 78. If desired a subset of the detonators or, in extreme cases all the detonators, can be assigned firing times individually. This feature allows detonators which are not part of a regular blasting pattern to be easily accommodated. The use of auto-search and auto-programming features simplifies the task of assigning firing times to the detonators, compared to the use of a technique in which the times are manually assigned to the detonators.

In the control unit 70 a table is thus established in which the various detonators, which are designated by their respective identity codes, have respective firing times uniquely associated with the detonators. These firing times may vary from one another or, depending on the blasting requirements, the firing times for certain detonators may be the same.

The control unit 70 is then connected to the harness 16 and is used to transfer the timing information to the respective detonators. This connection can be physical, via two wires, fibre optic cables etc, or can be done wirelessly by means of a radio frequency or infra red link. Also, the control unit may form part of control apparatus which embodies a number of control units connected and regulated to act in parallel and in synchronisation, or connected in a master-slave configuration wherein a master control unit regulates the operation of a number of slave control units, with each slave control unit controlling the initiation of a separate group of detonators. The timing information is correctly targeted to each detonator through the use of the corresponding identity code which allows the processor 32 to recognise the identity code and then to accept the timing information which is stored in the memory 34 in addition to the identity code or, alternatively, by overwriting the identity code in the respective detonator.

The detonators can be configured to respond, universally, to a broadcast address or signal. Thus with a single detonator connected to the harness communication can be established with the detonator irrespective of its identity code.

Figure 4:
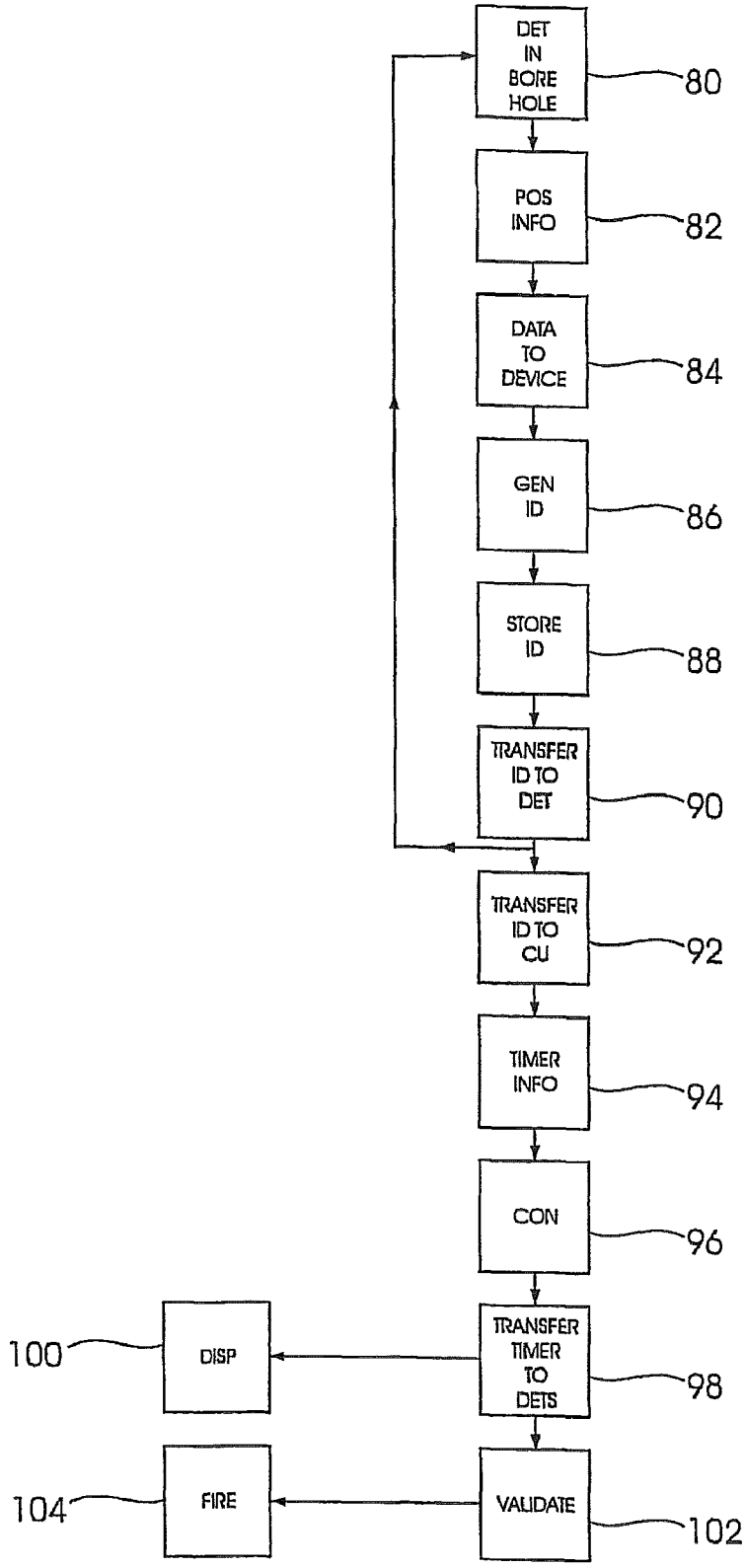
FIG. 4 is a flow chart of steps in the method of the invention.

FIG. 4 is a flow chart summary of the preceding description. Each detonator 14A, 14B . . . 14N (FIG. 1) is placed (80) in a respective borehole and positional information (82), dependent on the location of the detonator in the blast array, is input (84) into the portable device. This device generates the identity code (86) which is stored in the device (88) and transferred to the detonator (90). This process is repeated until all the detonators have been identified in this way.

Thereafter the identity codes are transferred to the control unit (92). Either the portable device is transported to the control unit and data transfer then takes place directly by direct or wireless links, or the codes are transferred by an intermediate medium. Another possibility is that the control apparatus, or a control unit therein, once connected to the harness, searches for particular identity codes to establish which detonators are connected to the harness, and where the detonators are. The timing information is then generated (94) or acquired from any external source. The control unit is thereafter connected to the harness (96) and the timing information is transferred to the detonators (98). A blast pattern can be generated and displayed at the control unit (100).

As noted the individual detonators are calibrated, at any appropriate time, using any suitable technique to ensure that the timing information is accurately employed at each respective detonator.

A validation procedure can be effected (102) and thereafter a firing sequence is initiated (104).

When blasting is to occur the power supply 74 (FIG. 3) is used, under the control of protocols which are known in the art, to charge the various capacitors 36 in the detonators. Each capacitor then acts an energy source to power the further operation of the detonator. A firing signal which is generated by the software 82 is then broadcast on the harness 16 (FIG. 1) and triggers the start of the programmed time interval at each respective detonator. At the end of the respective time interval the corresponding bridge 30 (FIG. 2) is fired.

As has been pointed out the portable device 24 (FIG. 2) is incapable of firing any detonator and is used merely to assign identity codes to the detonators and to collect this information for transfer to the control unit. The control unit directs firing time information to the various detonators in a unique manner, charges the capacitors and generates the blast signal.

In the preceding description the portable device and control unit are represented as being physically separate. This is not necessarily the case, for the distinction could be notional or functional only, and the portable device could be integrally constructed in a physical sense with the control unit.

The invention is based on the allocation of unique identity codes to the detonators using the criteria referred to. However, due to human error or other factors, a detonator in the array may not be assigned an identity code. This type of oversight can be detected in different ways.

Firstly each detonator, under factory conditions, can be assigned the same identity code (e.g. all zero) and, when the detonator is installed, the location—dependent identity code is then used to overwrite the factory code. The blaster, when testing an installation, can use the portable device or control unit to search for detonators which still carry the factory assigned code i.e. these detonators which have not been given location—dependent codes.

Secondly, the processor 32 in each detonator can be programmed to indicate, in response to a suitable interrogating signal, whether or not a location—dependent identity code has been assigned to the detonator. This is easily done for example by setting a check bit in a memory of a detonator once an identity code has been allocated to the detonator.

The invention claimed is:

1. A blasting system which comprises a plurality of electronic detonators which are configured in a blast array which is formed by a plurality of boreholes arranged in at least one row wherein each row is assigned a respective row identifier and each borehole in each row is assigned a respective borehole identifier and each borehole contains at least one detonator, each detonator including a memory in which is stored at least respective firing time information and a respective unique identity code which comprises the respective row identifier and the respective borehole identifier, a harness which interconnects the detonators, and a control unit, connected to the harness, which generates a signal to fire the detonators.

2. A blasting system according to claim 1 wherein at least one borehole contains a first detonator and a second detonator and the identity code for the first detonator is distinguishable from the identity code of the second detonator.

3. A blasting system according to claim 1 which includes a portable device with a mechanism for generating the respective identity code for each detonator, means for transferring the identity code to the respective detonator and a first memory in which the identity code is stored.

4. A blasting system according to claim 3 wherein the control unit includes a control memory and the portable device includes an interface for transferring the identity codes from the first memory to the respective detonators.

5. A blasting system according to claim 1 wherein the control unit includes a control memory in which is stored firing time information for each detonator.

6. A blasting system according to claim 5 wherein the control unit includes an interface for transmitting respective firing time information to each detonator.

7. A blasting system according to claim 6 wherein the firing time information is transmitted via the harness.

8. A blasting system according to claim 6 wherein the firing time information is transmitted via a wireless link.

9. A blasting system according to any one of claims 1 to 8 wherein the harness comprises two elongate conductors which connect the detonators in parallel to one another.

10. A blasting system which comprises a plurality of electronic detonators which are spatially distributed from one another in an array which is formed by a plurality of boreholes arranged in at least one row wherein each row is assigned a respective row identifier and each borehole in each row is assigned a respective borehole identifier and each borehole contains at least one detonator, each detonator including a memory in which is stored at least respective firing time information, a harness which connects the detonators in parallel to one another, a portable device in which are stored respective unique identity codes for the detonators, each identity code comprising the respective row identifier and the respective borehole identifier, and a control unit in which are stored the identity code and firing time information for each detonator, and which transmits a firing signal to the detonators.

11. A blasting system according to claim 10 wherein the firing signal is transmitted on the harness to the detonators.

12. A blasting system according to any one of claim 1, 2, 3, 10 or 11 wherein the harness comprises two elongate conductors and a plurality of connectors to provide at least one connector for each detonator, the connectors being connected at intervals to the conductors.

13. A blasting system according to claim 3 or claim 5 wherein at least one borehole includes both a first detonator and at least a second detonator and the identity code for each detonator in the borehole is distinguishable from the identity code of each other detonator in the borehole.

14. A method of blasting comprising installing explosive material and at least one electronic detonator having a memory in each of a series of boreholes, the boreholes being configured in a blast array in which the boreholes are arranged in at least one row, the method comprising:

assigning a respective row identifier and a respective borehole identifier to the boreholes in each row;

storing in the memory of each detonator a respective unique identity code which comprises at least the respective row identifier and the respective borehole identifier;

storing in the memory of each detonator respective firing time information;

interconnecting each detonator to a harness and connecting the harness to a control unit having a memory, the detonators, the harness and the control unit together comprising a blasting system; and generating a signal from the control unit and transmitting the signal to the detonators to fire the detonators.

15. The method according to claim 14 comprising placing in at least one of the boreholes a first detonator and at least a second detonator and assigning to each of the detonators in the borehole respective identity codes, wherein the identity code assigned to each detonator in the borehole is distinguishable from the identity code assigned to each other detonator in the borehole.

16. The method according to claim 14 further comprising generating the respective identity code for each detonator by use of a portable device having a mechanism for generating the respective identity codes and a first memory for storing the generated identity codes and transferring the respective identity codes from the portable device to the respective detonators.

17. The method according to claim 14 further comprising transmitting the signal to fire the detonators via the harness.

18. The method according to claim 14 further comprising transmitting the signal to fire the detonators via a wireless link.

19. The method according to claim 14 further comprising storing respective firing time information into each detonator only after completing storing of the respective identity codes in each detonator of the blast array.

20. The method according to claim 14 wherein the step of storing the respective firing time information in the memory of each detonator is carried out (a) after completion of storing the unique identity code in each detonator, and (b) from a location which is remote from the blast array.

21. The method according to claim 19 wherein the firing time information is generated only after completing storing of the respective identity codes in each detonator.

22. The method according to claim 21 further comprising developing the firing times by use of an algorithm using fixed inter-row, inter-hole and, optionally, inter-detonator timings.

23. The method according to claim 21 further comprising generating the timing information externally of the blasting system and then loading the firing time information into the memory of the control unit.

24. The method according to claim 22 wherein there is at least one instance of two or more detonators in the same borehole, and using the fixed interdetonator timing for detonators in the same borehole.

25. The method according to any one of claims 14 to 16 wherein the harness is a two-wire harness.

26. The method according to any one of claims 14 to 16 wherein the blast array includes at least two rows of boreholes.

* * * * *